United States Patent [19]

Swan

[11] 4,166,568

[45] Sep. 4, 1979

[54] POLYGONAL CONTAINER

[76] Inventor: Walter B. Swan, 7030 W. 100th St., Chicago Ridge, Ill. 60415

[21] Appl. No.: 916,587

[22] Filed: Jun. 19, 1978

[51] Int. Cl.[2] ..... B65D 13/04

[52] U.S. Cl. ..... 229/23 R; 229/41 C; 229/39 R

[58] Field of Search ..... 229/23 BT, 23 R, 39 R, 229/41 C

[56] References Cited

U.S. PATENT DOCUMENTS

| | | | |
|---|---|---|---|
| 2,307,913 | 1/1943 | Bergstein | 229/39 R |
| 2,483,464 | 10/1949 | Johnson | 229/222 |
| 2,565,182 | 8/1951 | Maxon | 229/17 R |
| 2,922,562 | 1/1960 | Pellaton | 229/41 C |
| 3,000,496 | 9/1961 | Larson | 229/41 C X |
| 3,016,181 | 1/1962 | Desmond | 229/39 R |
| 3,101,167 | 8/1963 | Styler | 229/41 C |
| 3,526,352 | 9/1970 | Swett | 229/39 R |
| 3,563,448 | 2/1971 | Croley | 229/23 BT |
| 3,773,246 | 11/1973 | Tyrseck | 229/39 R |
| 3,901,431 | 8/1975 | Carlson | 229/41 C X |
| 3,941,300 | 3/1976 | Troth | 229/5.5 |
| 3,977,594 | 8/1976 | Swan | 229/39 R |
| 4,065,047 | 12/1977 | Swan | 229/41 C |

FOREIGN PATENT DOCUMENTS

| | | | |
|---|---|---|---|
| 158551 | 8/1954 | Australia | 229/41 C |
| 500292 | 3/1954 | Canada | 229/39 R |
| 1559856 | 2/1969 | France | 229/39 R |
| 1201192 | 8/1970 | United Kingdom | 229/39 R |

*Primary Examiner*—Davis T. Moorhead

[57] ABSTRACT

A polygonal container having a container sides assembly and a separate container bottom assembly, which is adapted for interlocking engagement with the container sides assembly at a lower portion thereof thereby to form the container bottom. The container sides assembly is foldably formed from a unitary blank of relatively rigid but foldable material and has a plurality of generally rectangular side panels hingedly interconnected to form an enclosure defining the sides of the polygonal container. A plurality of lower edge flaps are hingedly connected to the lower edge of the rectangular side panels and are adapted for folding upwardly and inside the enclosure to interlockingly receive corresponding elements of the container bottom assembly. The container bottom assembly is also foldably formed from a unitary blank of relatively rigid but foldable material and has a plurality of generally triangular bottom panels equal in number to the side panels, a plurality of interconnecting webs each web being foldably disposed between a pair of adjacent triangular bottom panels and downwardly therefrom for disposing adjacent bottom panels in abutting relationship at two sides of the triangular bottom panels. The container bottom assembly further includes a plurality of ear members corresponding in number to the number of lower edge flaps on the container side assembly, each of which ear member is hingedly connected to the third side of a triangular bottom panel and downwardly extending therefrom for engagement with the flaps hingedly connected at the bottom portion of the container sides assembly.

15 Claims, 10 Drawing Figures

POLYGONAL CONTAINER

BACKGROUND OF THE INVENTION

The present invention relates generally to polygonal containers, and more particularly to a polygonal container having interlocking container sides and bottom assemblies which are each preferably formed from unitary blanks of relatively rigid, but foldable, materials to form a container having a strong weight supporting bottom, which bottom will cushion the contents of the container, and further which bottom will elevate the contents of the container from resting immediately adjacent the ground.

In the prior art various polygonal containers have been proposed for containing various types of goods. A variety of different materials, including paperboard, fiberboard, and various corrugated materials have been proposed. Although many of such prior art polygonal containers have been generally acceptable for general and/or limited use, typically such prior art polygonal containers have been less than optimal in their weight supporting capacity. Also the prior art container has frequently utilized an uncushioned bottom, frequently resulting in the excessive powdering of pelletized materials. Moreover, such prior art containers have utilized configurations where the contained material rested upon a bottom which was supported directly on and by the ground, thereby frequently resulting in additional damage, such as for example water damage, to the contents thereof.

In view of the above difficulties associated with the prior art, it is an object of the polygonal container of the present invention to provide a container which has increased weight-supporting capacity.

It is also an object of the polygonal container of the present invention to provide a container having a bottom portion which functions to cushion the contained goods.

It is an additional object of the polygonal container of the present invention to provide a container which has a bottom raised above the ground, such that the contents of the container are not supported directly on the ground.

It is a further object of the polygonal container of the present invention to provide a container having a container sides assembly and a separate container bottom assembly adapted for interlocking engagement with the container sides assembly at a lower portion thereof.

It is a yet further object of the polygonal container of the present invention to provide a container having a container bottom assembly comprising a plurality of generally triangular bottom panels equal in number to the number of side panels of the container sides assembly, a plurality of interlocking webs, each web foldably disposed between a pair of adjacent triangular bottom panels and downwardly extending therefrom to dispose adjacent triangular bottom panels in abutting relationship on two sides thereof, and a plurality of ear members corresponding in number to the number of lower edge flaps on the container sides assembly, which ear members are hingedly connected to the third side of the triangular bottom panel and extending downward therefrom for engagement with the hingedly connected flaps of the side panels.

It is a yet additional object of the polygonal container of the present invention to provide a container wherein webs of the container bottom assembly are longitudinally divided into two approximately equal rib sections connected by fold line therebetween, each web being folded upon the fold line to approximately 180°, whereby the rib sections of the web are disposed in facing and abutting relationship.

It is also an additional object of the polygonal container of the present invention to provide a container having a container bottom assembly wherein the webs thereof are generally rectangular in shape.

It is another object of the polygonal container of the present invention to provide a container having a container bottom assembly wherein the triangular bottom panels and the interconnected webs are disposed in a circular configuration, for convenience of folding of the unitary bottom blank into the container bottom assembly.

These and other objects and advantages of the polygonal container of the present invention will become apparent to one of ordinary skill in the art in view of the following specification.

SUMMARY OF THE PRESENT INVENTION

In the polygonal container of the present invention there is provided a container which is polygonal in shape and has a container sides assembly and a separate container bottom assembly which is adapted for interlocking engagement with the container side assembly at the lower portion thereof. The container side assembly in general preferably comprises a unitary blank of relatively rigid, but foldable, material having a plurality of generally rectangular side panels hingedly interconnected to form an enclosure defining the sides of the polygonal container. The container sides assembly also has a plurality of lower edge flaps hingedly connected to the lower edge of the rectangular side panels and adapted for folding upwardly and inside the enclosure to interlockingly receive and engage the corresponding element of the container bottom assembly.

The container bottom assembly comprises a plurality of generally triangular bottom panels equal in number to the side panels, a plurality of connecting webs each foldably disposed between a pair of adjacent triangular bottom panels and downwardly therefrom for disposing adjacent triangular bottom panel sides in abutting relationship at two sides of the triangular bottom panels. The container bottom assembly further has a plurality of ear members corresponding in number to the number of the lower edge flaps of the container sides assembly each of which ear member is hingedly connected to the third side of a triangular bottom panel and downwardly extending therefrom. The functioning of the above structure is engagement between the hingedly connected flap and the ear members, thereby to provide a strong and stable bottom for the container.

Figure 1:
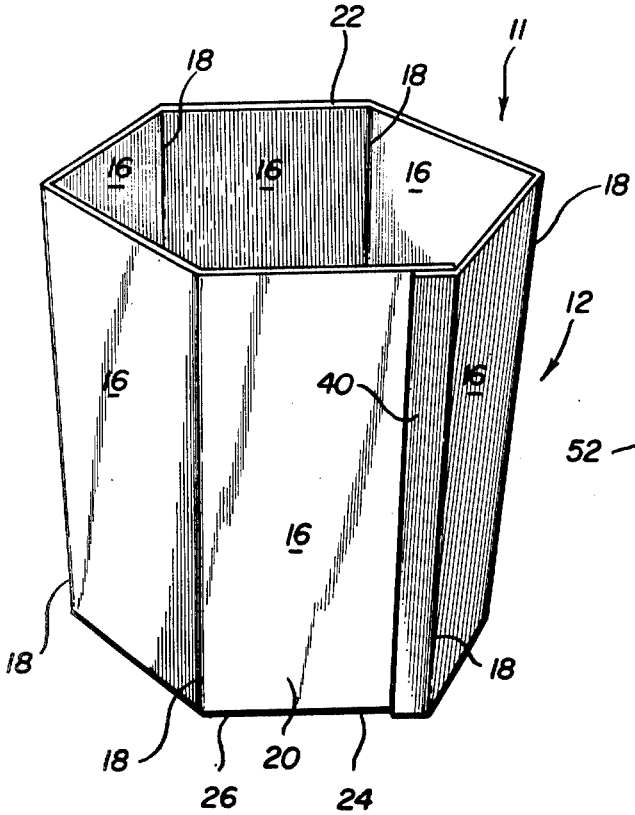
FIG. 1 is a perspective view of the polygonal container of the present invention, showing the container sides assembly thereof with the longitudinally extending side flap on one side of the folded and assembled container blank fixedly connected to the free edge of the opposite side of the container blank, thereby to form the enclosure making up the container sides.
Figure 2:
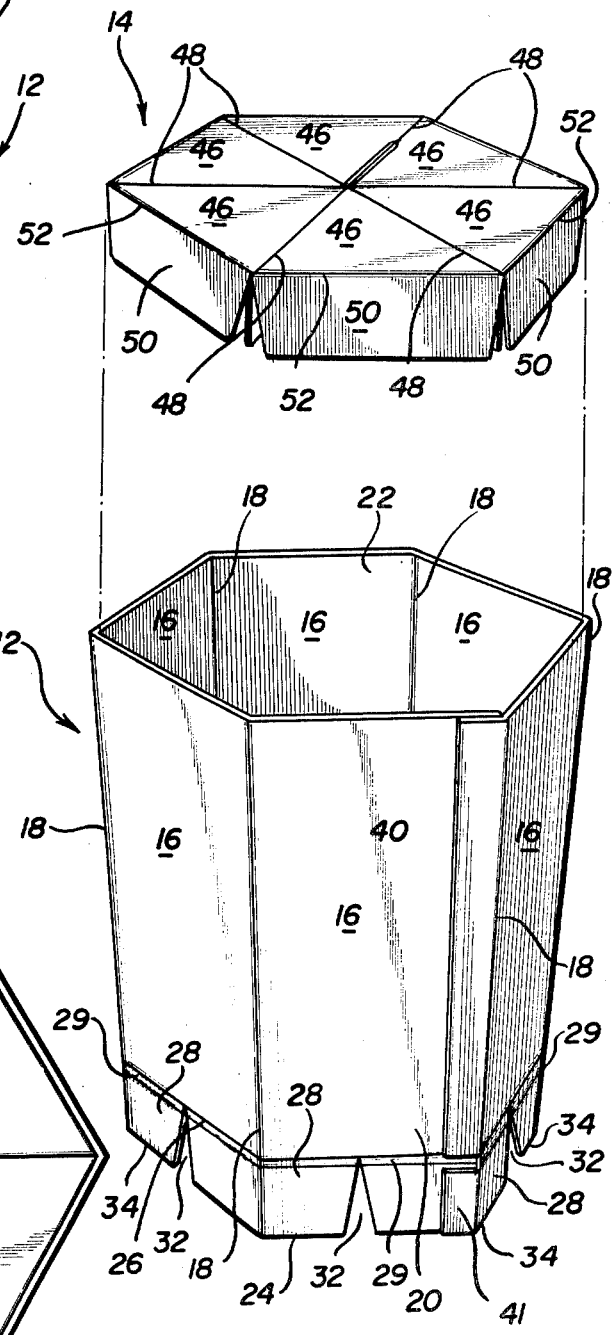
FIG. 2 is an exploded perspective view showing both the container sides assembly and the container bottom assembly disposed thereabove, which container bottom assembly is to be inserted into the opening at the top of the container sides assembly for engagement between the lower edge flaps of the container sides assembly and the downwardly extending ear members of the container bottom assembly.
Figure 5:
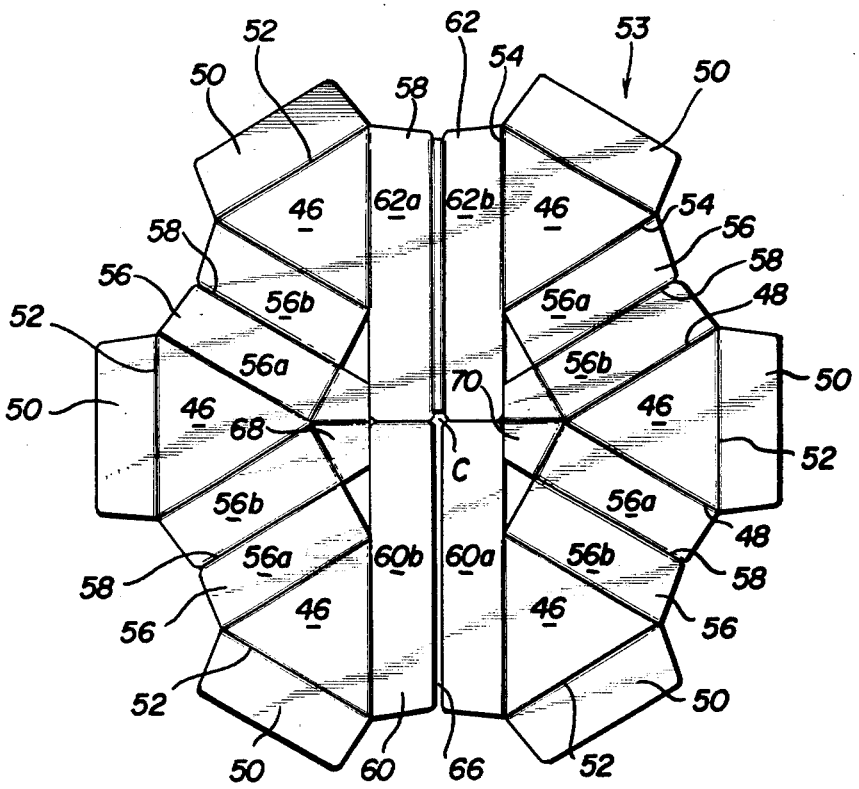
Figure 6:
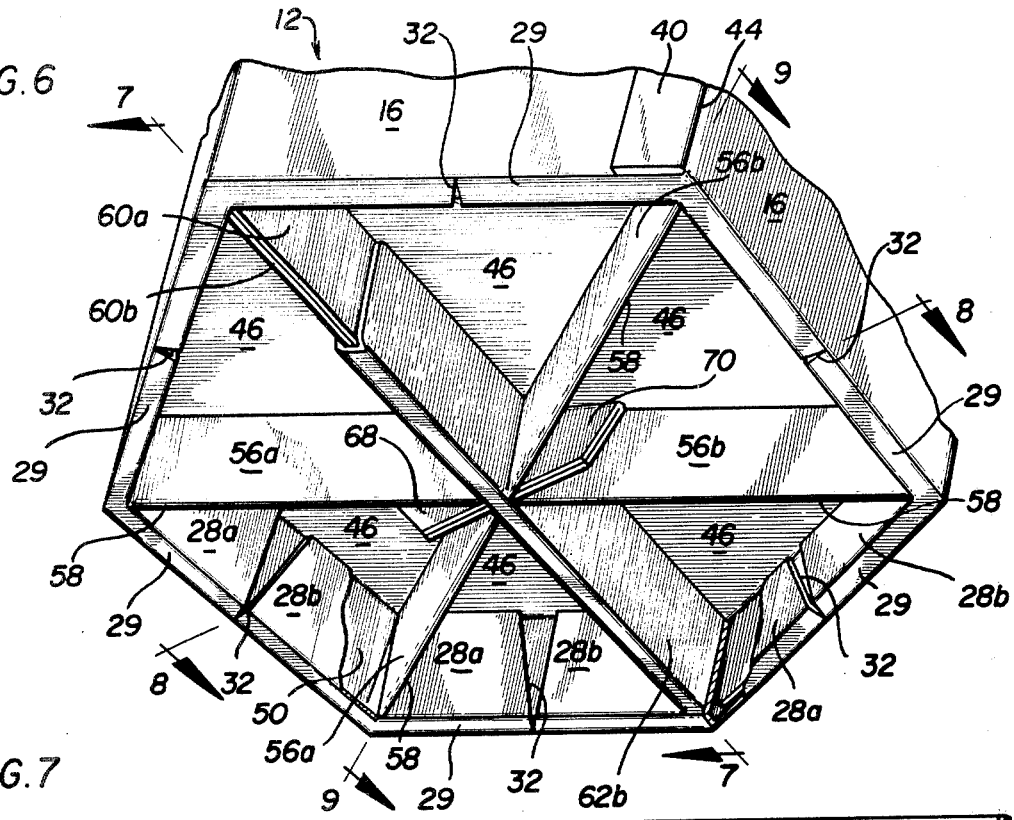
Figure 7:
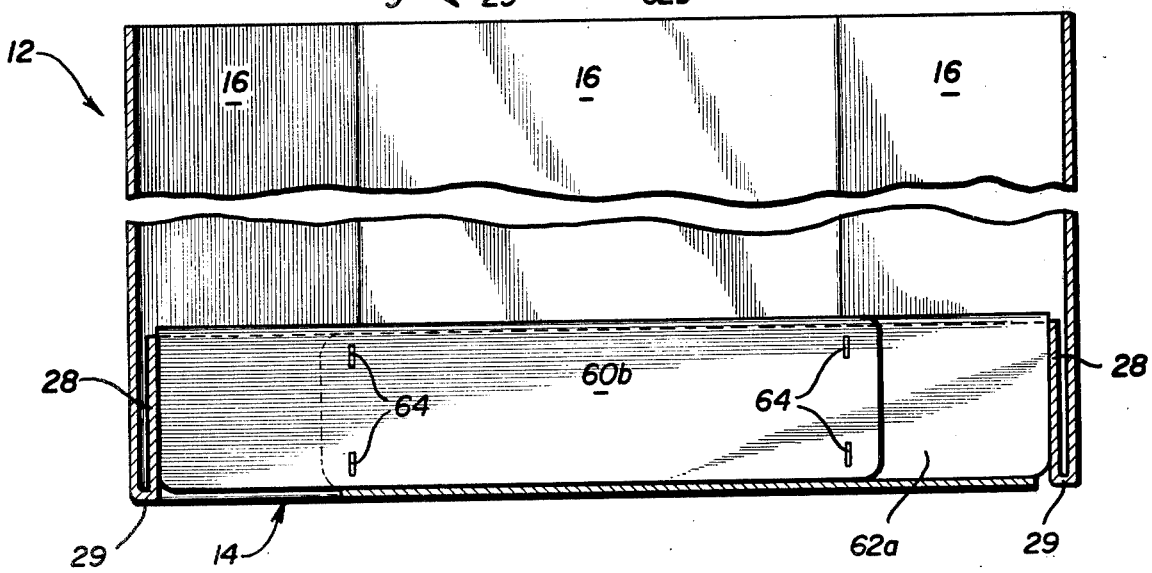
Figure 8:
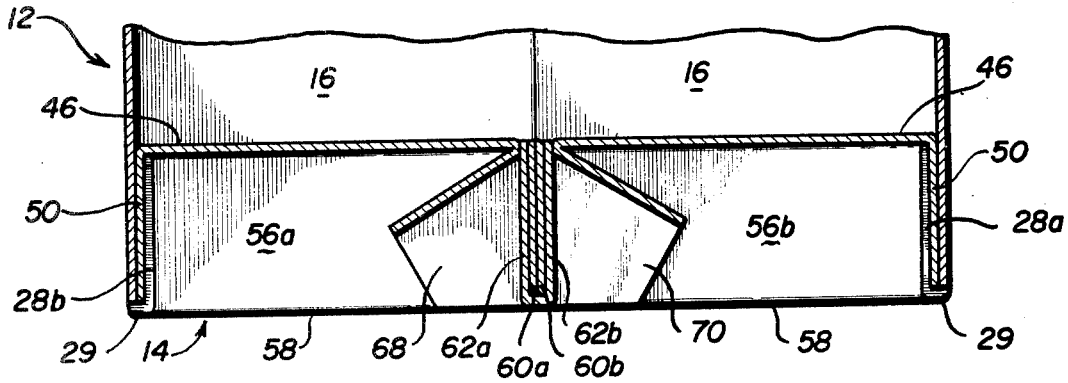
Figure 9:
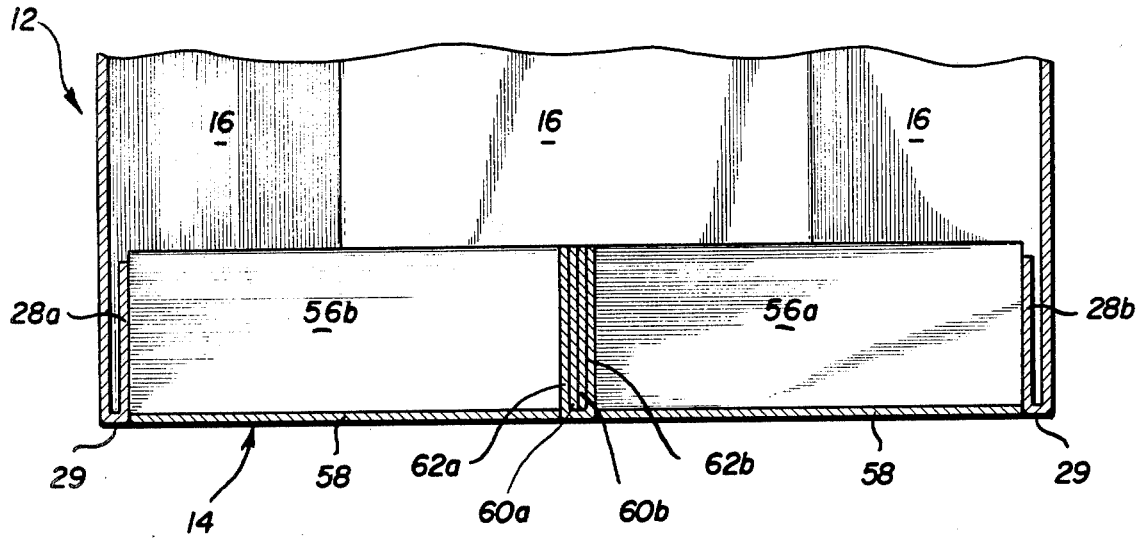
Figure 10:
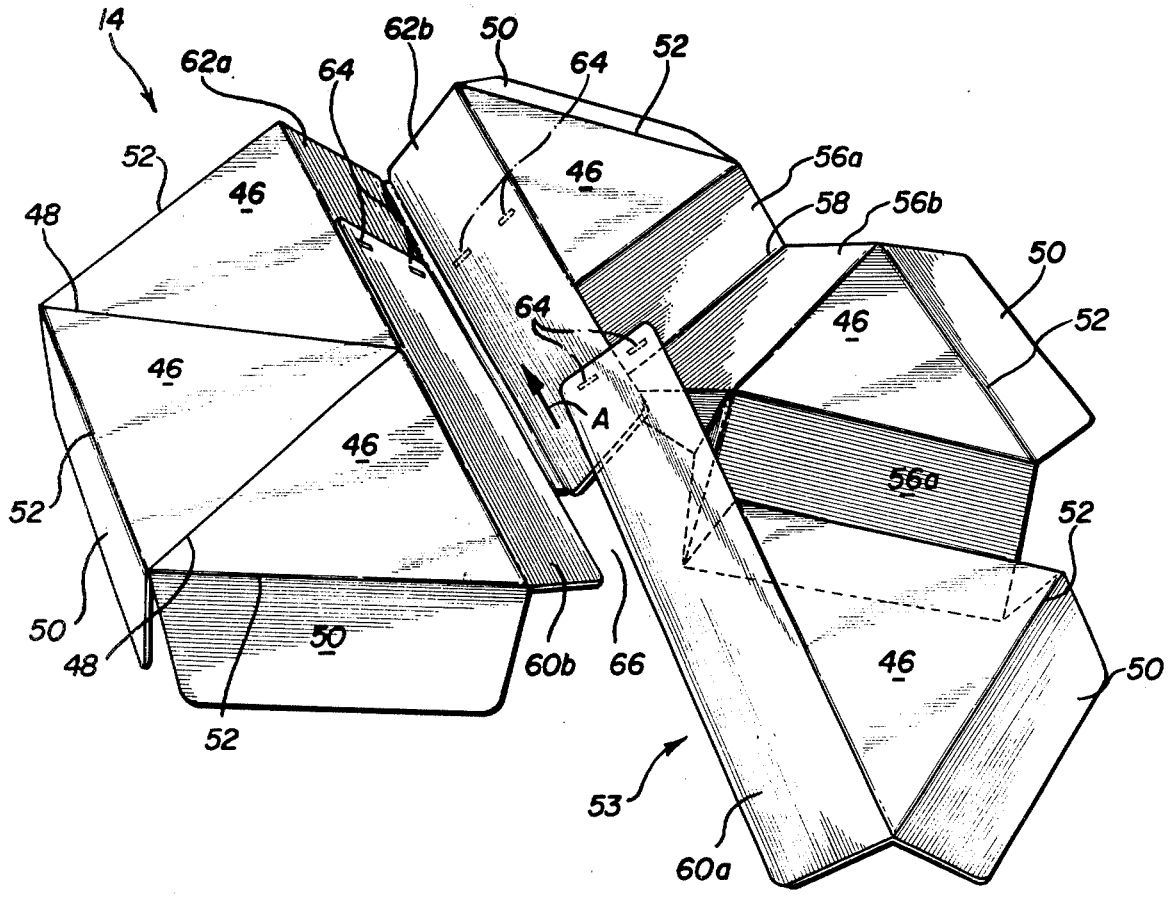

FG. 4 is a plan view of the unitary blank for the container sides assembly showing the generally rectangular side panels, flaps extending from the lower portion thereof, such flaps containing slits therein, and such unitary blank having a free edge at one side thereof and a longitudinally disposed side flap hingedly connected to the opposite side thereof for fixed connection to the free edge to assemble the enclosure forming the container sides, as shown in FIGS. 1 and 2;

FIG. 5 is a plan view of the unitary blank for forming the container bottom assembly showing generally triangular bottom panels hingedly interconnected with generally rectangular webs, which webs comprise two rib portions separated by a fold line, and which triangular bottom panels have disposed at the other portions thereof hingedly connected ear portions for engagement with the bottom disposed flaps of the container sides assembly;

FIG. 6 is an enlarged bottom perspective of the polygonal container of the present invention showing the container sides assembly partially cut away and in an engaged disposition with the container bottom assembly;

FIG. 7 is a transverse cross-sectional view taken along line 7—7 of FIG. 6 and showing the insertion of a first web into a second web which is oppositely disposed across the circular configuration of the container bottom assembly, whereby upon securement of a first and second web together, such as by means of staples, the container bottom assembly is securely held in its folded configuration;

FIG. 8 is transverse cross-sectional view taken along line 8—8 of FIG. 6 showing oppositely disposed web extensions engaging either side of the first and second slidably inserted and extended length webs as shown in FIG. 7;

FIG. 9 is a transverse cross-sectional view of the polygonal container of the present invention taken along lines 9—9 of FIG. 6 showing a longitudinal view of two rib portions of two webs engaging either side of the first and second slidably inserted and extended length webs, as set forth in FIG. 7; and FIG. 10 is top perspective view of the unitary blank for forming the container bottom assembly as shown in FIG. 5, the left side of which is disposed in its folded configuration with the triangular bottom panels in abutting relationship and the hingedly disposed ear portions projecting downwardly therefrom, and the right side of the depicted unitary blank for forming the container bottom assembly in partially folded disposition showing the webs interconnecting the triangular bottom panels and one of the oppositely disposed slidably inserted and extended length webs prepared for sliding engagement in the direction shown by Arrow A into and along the length of the oppositely disposed extended length web for stapling to complete the assembly of the container bottom assembly in folded disposition.

DETAILED DESCRIPTION OF PREFERRED EMBODIMENTS

The polygonal container of the present invention has a container side assembly and a separate container bottom assembly. The container bottom assembly is adapted for interlocking engagement with the container side assembly at the lower extremity thereof for forming the container bottom. The container side assembly in general preferably comprises a plurality of rectangular side panels hingedly interconnected to form when in folded and secured configuration an enclosure defining the sides of the polygonal container. The lower edge flaps are hingedly connected to the lower edge of the rectangular side panels and are adapted for folding upwardly and inside the enclosure for interlockingly receiving corresponding elements from the container bottom assembly.

The container bottom assembly in general preferably includes a plurality of triangular bottom panels equal in number to the number of side panels. A plurality of interconnecting webs is further included, each web being foldably disposed between a pair of adjacent triangular bottom panels and downwardly extending therefrom to dispose the triangular bottom panels in abutting relationship at the two sides of the triangular bottom panels. A plurality of ear members corresponding in number to the number of lower edge flaps of the container sides assembly is also an element of the container bottom assembly, each ear member being hingedly connected to the third side of the rectangular bottom panel and extending downwardly therefrom for engagement with the hingedly connected flaps of the container sides assembly.

The number of rectangular side panels in the polygonal container of the present invention may be even in number and four or greater, or odd in number and three or greater. The lower edge flaps of the container sides assembly preferably include slits extending from the lower extremity of the container sides portion and upwardly to the corresponding rectangular side panel. The function of such slits is to render the lower edge flaps more easily folded upwardly for engagement with the bottom assembly ear members. Such slits may be disposed for separating the lower edge flaps from each other by extending upwardly to a point disposed between two adjacent rectangular side portions to permit unitary folding of each flap upwardly to correspond to each individual rectangular side panel of the container sides assembly. Such slits may in other preferred embodiments extend upwardly to a point on a single rectangular side panel to permit engagement of a single ear member of the container bottom assembly with two adjacent lower edge flaps. In such a structure, the strength and stability of the engagement between the container bottom assembly and the container sides assembly of the polygonal container is enhanced.

In preferred embodiments of the polygonal container of the present invention, the container sides blank is formed from a unitary piece of relatively rigid, but foldable, material. One panel of the container sides blank has a free edge and a longitudinally extending side flap is hingedly disposed at the opposite side of the blank. Fixed engagement between such free edge and such longitudinally extending side flap forms the enclosure defining the container sides.

In the container bottom blank of the polygonal container of the present invention, each web thereof is preferably longitudanally divided into two approximately equal rib sections connected by a fold line therebetween. Each web is folded upon the fold line to approximately 180° to dispose the paired rib sections into facing and abutting relationship. Such webs are preferably generally rectangular in shape. In that case, the triangular bottom panels and the generally rectangular interconnecting webs cause the container bottom blank to be disposed in a circular configuration. Where the interconnecting webs, such as in alternative embodiments, are triangular in shape, the container bottom blank is disposed in a linear configuration.

In preferred embodiments of the container bottom blank disposed in circular configuration, two of such webs which are oppositely disposed across the circular configuration of the container bottom blank are extended in length to be adapted for sliding insertion one within the other. The result of such a structure is that when the container bottom blank is folded for operative engagement with the container sides blank, the slideable inserted and extended length webs may be stapled together, thereby to hold the container bottom blank in folded and operative configuration. One such extended length web may be preferably separated by a narrow channel extending from the exterior extremity of the web to the interior extremity thereof to permit easier sliding engagement of one web within the other and without any substantial distortion of the bottom container blank during folding thereof into such an operative configuration.

Referring now to the drawing and to FIG. 1 in particular, the polygonal container of the present invention, generally shown at 11, includes a container sides assembly, generally 12, and a container bottom assembly, generally 14, as shown in exploded relationship in FIG. 2. The container sides assembly 12 comprises a plurality of generally rectangular side panels 16 which are hingedly interconnected at folds 18 to form an enclosure 20 defining the sides of the polygonal container 11. Enclosure 20 bounded by rectangular side panels 16 has a top opening 22 and a bottom opening 24. Connected to the lower edge 26 of rectangular side panels 16 are a plurality lower edge flaps 28. Lower edge flaps 28 are adapted for folding upwardly and inside enclosure 20 at bottom opening 24 of container 11 by means of bottom edge fold lines 29 to interlockingly receive corresponding elements of container bottom assembly 14, a description of which is set forth in greater detail hereinbelow.

Figure 4:
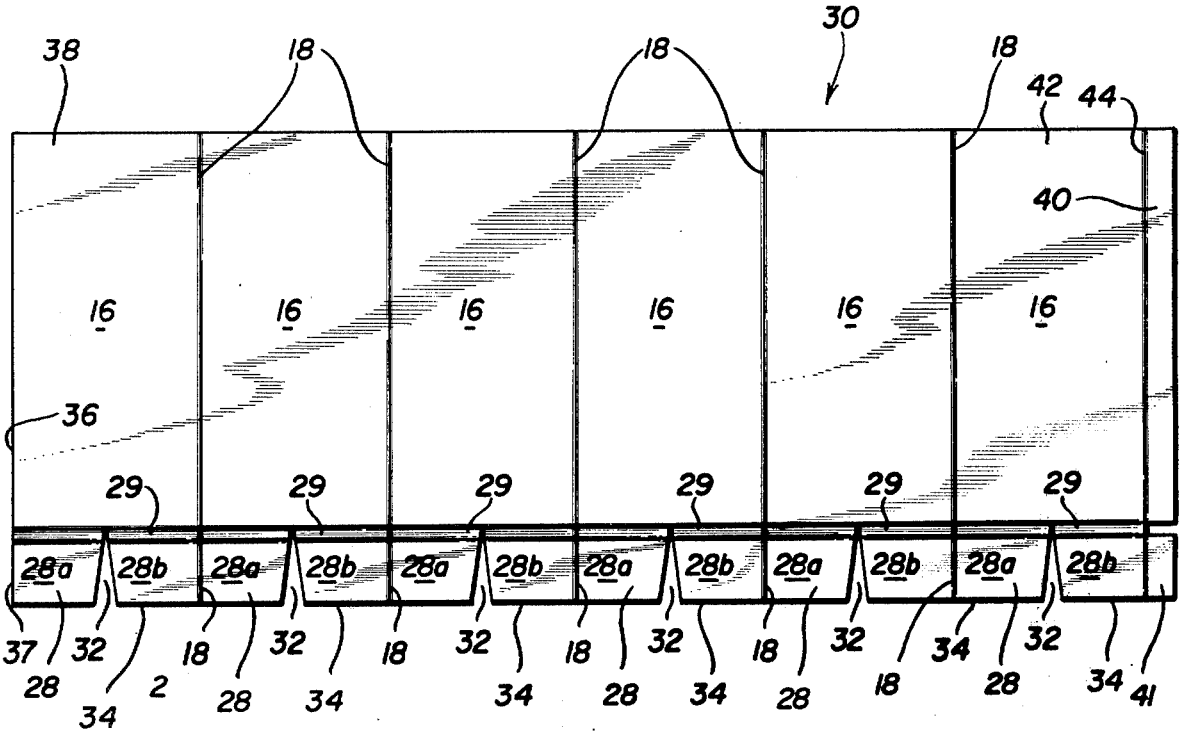

Referring now to FIG. 4, which shows a unitary blank, generally 30, for foldably forming container sides assembly 12, such sides unitary blank 30 has a plurality of generally rectangular side panels 16 hingedly interconnected at folds 18 in linear fashion. A plurality of flaps 28 are hingedly connected to lower edge 26 of rectangular side panels 16. In preferred embodiments, each lower edge flap 28 contains a slit 32 extending from the lower extremity 34 of flap 28 to the lower edge 26 of the corresponding rectangular side panel 16. Preferably, such lower edge flap slits 32 are disposed to divide each lower edge flap 28 into substantially equal portions **28*a*, 28*b* with respect to fold lines 18. In alternative embodiments, such slits 32 may be disposed elsewhere along lower edge flaps 28. Sides unitary blank 30, as shown in FIG. 4, has a free edge 36 at one side 38 thereof and a longitudinally disposed side flap 40 disposed at the opposite side 42 of sides unitary blank 30 at fold 44. As shown in FIGS. 1 and 2, longitudinally disposed and hinged side flap 40 is overlapped with free edge 36 of side 38 of sides unitary blank 30 to form a manufacturing joint for enclosure 20 of container sides assembly 12. Lower edge flap panel 41 is overlapped with free edge 37 of side 38 of sides unitary blank 30** to form a supplemental manufacturing joint.

Figure 3:
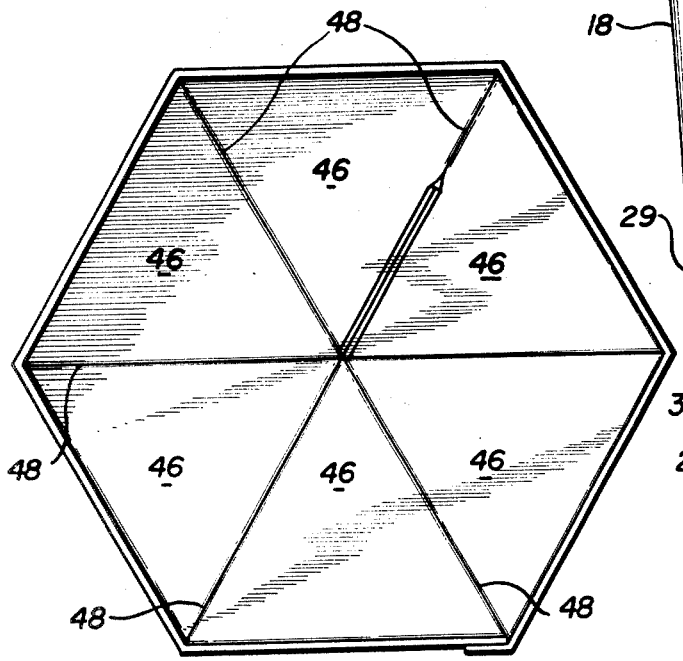
FIG. 3 is an enlarged top view of the polygonal container of the present invention looking downwardly through the top opening and showing the inside of the container sides assembly as engaged with the container bottom assembly.

Referring now to FIGS. 2 and 3, container bottom assembly 14 is shown in its folded configuration for interlocking engagement with container sides assembly 12. As shown in FIG. 2, container bottom assembly 14 includes a plurality of generally triangular bottom panels 46 which are equal in number to the number of rectangular side panels 16 of container sides assembly 12. Generally triangular bottom panels 46 are disposed in abutting relationship at the two interior sides 48 thereof to form the bottom of container 11 for supporting the contents thereof. Container bottom assembly 12 further includes a plurality of ear members 50 corresponding in number to the number of lower edge flaps 28 on the container sides assembly 12. Each ear member 50 is interconnected to the third interior side 52 of a triangular bottom panel 46 and extends downwardly therefrom for engagement with lower edge flaps 28 which are hingedly connected at bottom edge fold lines 29 of sides assembly 12. As shown in FIG. 2, container bottom assembly 14 is inserted into top opening 22 of container sides assembly 12 and pushed downwardly therein. Lower edge flaps 28 of container sides assembly 12 are folded upwardly and inside enclosure 20 bottom opening 24 of container sides assembly 12 to engage ear members 50 of container bottom assembly 14. In the embodiment shown in FIGS. 2, 3, and 4, each lower edge flap 28 engages two adjacent ear members 50 and each ear member 50 engages two portions **28*a*, 28*b* of lower edge flap 28, which portions 28*a*, 28*b* are separated by slits 32**.

Referring now to FIGS. 5 and 10, which show the unitary bottom blank 53 for folding and forming thereby container bottom assembly 14, the generally triangular bottom panels 46 are hingedly connected at two interior sides 48 thereof at bottom side fold lines 54 by a plurality of webs 56. Each web 56 is foldably disposed between a pair of adjacent triangular bottom panels 46 and may be folded downwardly therefrom for disposing adjacent bottom panels in abutting relationship at two interior sides 48 thereof.

Container bottom assembly 14 further includes a plurality of ear members 50 hingedly connected at the third, exterior side 52 of each triangular bottom panel 46. Each of webs 56 is longitudinally divided into two approximately equal and paired rib sections **56*a*, 56*b* which are in general connected by a fold line 58 therebetween. Each web 56 is folded upon its corresponding fold line 58 to approximately 180° to dispose the paired rib sections 56*a*, 56*b* of each web 56 in facing and abutting relationship. When web 56 of container bottom assembly 14 are rectangular in shape, the resulting unitary bottom blank 53 for foldably forming container bottom assembly 14 disposes triangular bottom panels 46 and interconnecting webs 56 in a circular configuration, as shown in FIG. 5**. In an alternate embodiment where the webs are triangular in shape (not shown), unitary bottom blank for forming the container bottom assembly is linear in configuration.

Referring now particularly to FIGS. 5–10, two selected webs 60, 62 which are oppositely disposed across the circular configuration container bottom assembly 14 are extended radially in length toward the center C of the circular configuration, as is shown especially in FIG. 10. Thus, when paired rib sections 56*a*, 56*b* of the webs 56 are folded into facing and abutting relationship as shown in particularly FIGS. 2, 3, and 10 in folding unitary bottom blank 53, one of the selected oppositely disposed and extended length webs 60 may be slidably inserted into the oppositely disposed extended length web 62, as shown in the right hand portion of FIG. 10 (See Arrow A). When unitary bottom blank 53 for forming container bottom assembly 14 is folded thusly, it may be fixed in the folded configuration by, for example securing with staples 64 the slidably inserted oppositely disposed and extended length webs 60, 62.

In a preferred embodiment, one of the oppositely disposed and extended length webs 60 of container bottom assembly 14 has rib portions 60*a*, 60*b* separated by a narrow channel 66 as shown in FIG. 5 extending from the exterior extremity 68 of the extended length web 60 to the center C of container bottom blank 53. Such channel 66 facilitates insertion of such split web 60 into the oppositely disposed web 62 during folding to form the container bottom assembly 14. Such slidably engaging overlap of the oppositely disposed webs 60, 62 is also shown in a bottom perspective in FIGS. 6 and 7.

Referring now particularly to FIGS. 5, 6, and 8, the rib portions of the webs connected to the triangular bottom panels which are disposed at 90° to the slidably insertable and engageable extended length webs 60, 62 are provided with frusto-triangular web extentions 68, 70 to provide strength and stability to container bottom assembly 14 when in folded configuration.

In general any material which is subtantially rigid, but foldable, may be utilized for the container sides and container bottom assemblies of the present invention. Examples are fiberboard, paperboard, various types of sheet plastics, and various corrugated materials. The container sides and bottom assemblies may be made of different materials, or of different grades or gauges of the same material. The container bottom and container sides assemblies may be secured in folded and operative configuration by staples, adhesives, or other suitable holding means.

The basic and novel characteristics of the polygonal container of the present invention will be readily understood from the foregoing disclosure by those skilled in the art. It will become readily apparent that various changes and modifications may be made in the form, construction, and arrangement of the polygonal container of the present invention as set forth hereinabove without departing from the spirit and scope of the invention. Accordingly, the preferred and alternative embodiments of the present invention set forth hereinabove are not intended to limit such spirit and scope in any way.

What is claimed is:

1. A polygonal container having a container sides assembly and a separate container bottom assembly which is adapted for interlocking engagement with said container sides assembly at the lower portion thereof for forming the container bottom:

said container sides assembly comprising:

a plurality of generally rectangular side panels hingedly interconnected to form an enclosure defining the sides of the polygonal container;

and a plurality of lower edge flaps hingedly connected to the lower edge of said rectangular side panels and adapted for folding upwardly and inside the enclosure to interlockingly receive corresponding elements from said container bottom assembly; and said container bottom assembly comprising:

a plurality of generally triangular bottom panels equal in number to said side panels;

a plurality of interconnecting webs, each web foldably disposed between a pair of adjacent triangular bottom panels and downwardly therefrom for disposing adjacent said triangular bottom panels in abutting relationship at two sides of said triangular bottom panels;

a plurality of ear members corresponding to said lower edge flaps on said container sides assembly, each of which ear member is hingedly connected to the third side of a said triangular bottom panel and is downwardly extending therefrom for operative engagement with said lower edge flaps of said rectangular side panels of said container sides assembly to form said polygonal container.

2. The polygonal container of claim 1 wherein said lower edge flaps and said corresponding and engaging ear members are equal in number.

3. The polygonal container of claim 1 wherein the number of said rectangular side panels is even and greater than two.

4. The polygonal container of claim 1 wherein the number of said rectangular side panels is odd and greater than one.

5. The polygonal container of claim 1 wherein said lower edge flaps of said containers sides assembly are separated from each other by a slit extending from the lower extremity of said container sides assembly to the said corresponding rectangular side panel, whereby said lower edge flaps are more easily folded upwardly for engagement with said ear members of said container bottom assembly.

6. The polygonal container of claim 5 wherein said slits separating said lower edge flaps from each other extend from said lower extremity of said container sides assembly to a point disposed between two adjacent rectangular side panels to permit folding of each lower edge flap upwardly to correspond to each individual rectangular side panel of said container sides assembly.

7. The polygonal container of claim 5 where said slits separating said lower flaps from each other extend from said lower extremity of said container sides assembly to a point on a single rectangular side panel to permit engagement of a single ear member of said container bottom assembly with two adjacent lower edge flaps, whereby the strength and stability of the engagement between said container bottom assembly and said container sides assembly of the polygonal container is enhanced.

8. The polygonal container of claim 1 wherein said container sides assembly is foldably formed from a unitary blank of relatively rigid, but foldable, material and one said panel of said container sides assembly has an edge with a longitudinally extending side flap hingedly disposed therefrom with the panel disposed at the opposite side of said blank having a free edge for receiving said longitudinally extending side flap, thereby to form the sides of said container.

9. The polygonal container of claim 1 wherein said container bottom assembly is foldably formed from a unitary blank of relatively rigid, but foldable material.

10. The polygonal container of claim 1 wherein each said web is longitudinally divided into two approximately equal and paired rib sections connected by a fold line therebetween, each web being folded upon said fold line to approximately 180°, whereby said paired rib sections of said web are disposed in facing and abutting relationship.

11. The polygonal container of claim 1 wherein said webs of said container bottom assembly are generally rectangular in shape.

12. The polygonal container of claim 1 wherein said webs of said container bottom assembly are generally triangular in shape.

13. The polygonal container of claim 1 wherein said triangular bottom panels and said interconnecting webs are disposed in a circular configuration.

14. The polygonal container of claim 13 wherein first and second webs are oppositely disposed across the circular configuration of said container bottom assembly and at least one of said first and second webs is extended in length, said first web adapted for sliding insertion across said circular configuration of said container bottom assembly is folded for operative engagement with said container sides assembly.

15. The polygonal container of claim 14 wherein said webs comprise paired rib sections of approximately equal size, and one of said first and second oppositely disposed and extended length webs of said container bottom assembly has rib portions separated by a narrow channel extending from the exterior extremity of said extended length web to the interior extremity thereof, whereby said first web may be inserted without substantial distortion into said oppositely disposed second web during folding to form said container bottom assembly from said unitary blank for operative engagement with said container sides assembly.

* * * * *